United States Patent [19]

Troncoso

[11] Patent Number: 4,671,249

[45] Date of Patent: Jun. 9, 1987

[54] ARCHERY BOW ASSEMBLY

[76] Inventor: Vincent F. Troncoso, 14090-6100 Rd., Montrose, Colo. 81401

[21] Appl. No.: 815,029

[22] Filed: Dec. 30, 1985

[51] Int. Cl.[4] ..... F41B 5/00

[52] U.S. Cl. ..... 124/24 R; 124/DIG. 1

[58] Field of Search ..... 124/23 R, 24 R, 88, 124/86

[56] References Cited

U.S. PATENT DOCUMENTS

| | | | |
|---|---|---|---|
| 261,610 | 7/1882 | Howe | 124/23 R |
| 2,116,650 | 5/1938 | Zima | 124/23 R |
| 2,228,823 | 1/1941 | Helm | 124/23 R |
| 3,625,193 | 12/1971 | Palma | 124/23 R |
| 3,802,410 | 4/1974 | Palma | 124/23 R |
| 3,826,239 | 7/1974 | Palma | 124/23 R |
| 4,201,177 | 5/1980 | Holman et al. | 124/88 |

*Primary Examiner*—Richard C. Pinkham
*Assistant Examiner*—Gary Jackson
*Attorney, Agent, or Firm*—Donald E. Nist

[57] ABSTRACT

The archery bow assembly includes an archery bow such as a compound bow or recurve bow having a pair of spaced, flexible, resilient bow limbs, a handle interconnecting the bow limbs, a bowstring connected to the bow limbs and an arrow rest. The assembly also includes a pair of draw weight-increasing components releasably secured, as by bolts, screws and/or brackets, to the bow limbs, preferably to the front surfaces thereof. Such components could also be attached to the rear surfaces of the bow limbs, if desired. The draw weight-increasing components are in the form of elongated, flexible resilient strips or rods of wood, metal, rubber, plastic, composites of carbon or graphite or boron fiber and plastic and mixtures thereof and are placed flush with the bow limb front and/or rear surfaces or in longitudinal grooves therein. The draw weight-increasing components are simple, inexpensive, durable and effective to increase the draw weight any desired amount. Different ones of such components can be substituted rapidly to change the draw weight and thus allow a single bow to be used for a variety of purposes, for example, target practice, indoors and outdoors, as well as for hunting.

4 Claims, 8 Drawing Figures

ARCHERY BOW ASSEMBLY

BACKGROUND OF THE INVENTION

1. Field of the Invention

The present invention generally relates to archery equipment and more particularly to an improved archery bow assembly.

2. Prior Art

Target archery bows are seldom used for hunting, because the latter bows usually have much higher draw weights for greater killing power. High draw weights are a distinct disadvantage to target archers, particularly to indoor shooting, because they require too much muscle power and energy expenditure and lead over a normal target shooting session of many arrows to rapidly decreasing aiming stability and shooting accuracy. Moreover, some ranges will not even permit their use, because of their target destructive power. Consequently, archers who wish to shoot target archery, whether indoors or outdoors, and also wish to hunt with bows usually have separate bows for each activity.

Each archery bow is quite different in feel, holding characteristics, recoil angle and force, sight picture and other properties. Practice with a target bow, unfortunately, does not necessarily help shooting accuracy with a separate hunting bow. Shooting accuracy is, however, all important to the bow hunter, since he or she will have, at best, in a season, only a very few opportunities to accurately sight and shoot game. Therefore, each shot must count or the hunting effort is wasted.

Certain archery bows have detachable limbs, so that heavier or lighter draw weight limbs can be substituted, as needed. However, the detachable limbs are very expensive to purchase and, of course, have only a single draw weight, so that multiple archery activities may require three or more sets of limbs.

Accordingly, there is a need for a simple, inexpensive, rapid way of varying draw weight of an archery bow as needed, so that a single archery bow with a single set of limbs can be used efficiently for both target archery and hunting purposes, maximizing skill building with continued practice with the single bow.

SUMMARY OF THE INVENTION

The improved archery bow assembly of the present invention satisfies all the foregoing needs. The assembly is substantially as set forth in the Abstract. Thus, it includes an archery bow, either of the recurve type or compound bow type, preferably the latter, which has a pair of spaced, flexible, resilient limbs having flat front and rear surfaces, a handle interconnecting the limbs, an arrow rest and a bowstring connected to the limbs.

The assembly also includes draw weight-increasing components releasably connected, as by bolts, screws and/or brackets, to each limb, preferably to the front surface thereof. Such components are in the form of elongated, flexible, resilient rods or strips which abut the limb's smooth flat front or back or are releasably disposed in elongated grooves in the limb's front or back surfaces.

Of considerable importance, the rods or strips can be added to the limbs of a compound bow to change its draw weight without laboriously removing and replacing the bow's cables (bowstrings) and wheels, as is required when the bow's limbs are substituted to change the draw weight.

The components can be made of wood, plastic, metal, rubber, carbon, boron or graphite fiber-plastic composite, and mixtures thereof. Since the components are light in weight and very inexpensive and since their length, thickness, width and other dimensions can be varied, as needed, the draw weight of the bow can be changed rapidly, simple and inexpensively to any desired degree. The result is a single archery bow useful for target archery, indoors and outdoors, and for hunting and which can be conveniently used by the archer to practice and incrementally increase his or her shooting skill and accuracy, all without undue muscle fatigue and stress. Various other features and advantages of the present invention are set forth in the following detailed description and accompanying drawings.

DRAWINGS

DETAILED DESCRIPTION

FIGS. 1 & 2

Figure 1:
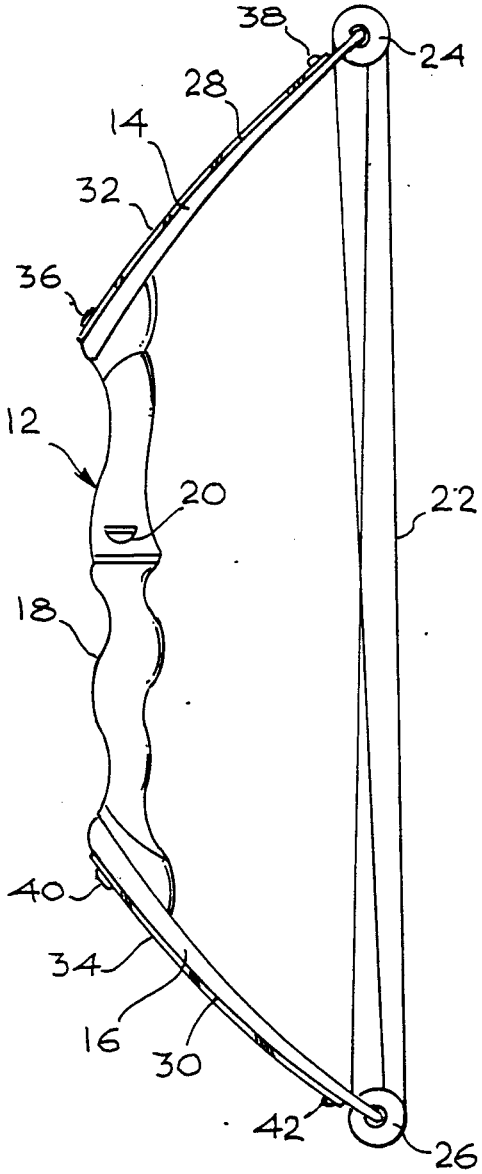
FIG. 1 is a schematic side elevation of a first preferred embodiment of the improved archery bow assembly of the present invention.
Figure 2:
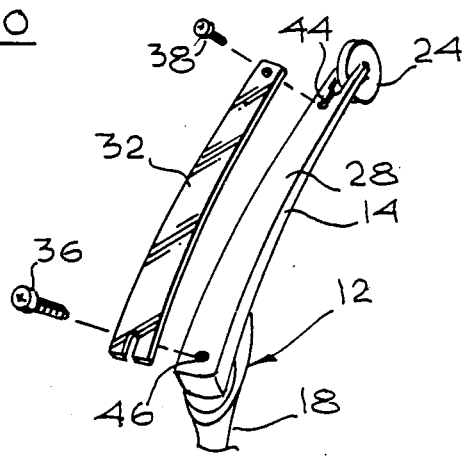
FIG. 2 is a schematic, perspective exploded view of one limb of the bow of FIG. 1.

Now referring more particularly to FIGS. 1 & 2, a first preferred embodiment of the assembly of the invention is schematically depicted therein. Thus, assembly 10 is shown which includes an archery bow 12 of the compound type, although a recurve non-compound archery bow could also be used, if desired. Bow 12 has a pair of flexible, resilient bow limbs 14 and 16 interconnected by a handle 18 bearing an arrow rest 20. The bowstring 22 is trained around pulley wheels 24 and 26 rotatably connected to the ends of limbs 14 and 16, respectively.

Assembly 10 also includes a pair of draw weight-increasing components releasably connected to the front surfaces 28 and 30 of limbs 14 and 16, respectively. Those components are in the form of elongated, flexible, resilient flat strips 32 and 34 of fiberglass, although wood, plastic, metal, rubber, or plastic-fiber composites such as those with carbon, graphite and/or boron fibers could be used. Strips 32 and 34 are releasably connected to limbs 14 and 16, respectively, by bolts or screws 36 and 38 through opposite ends of strip 32 and into limb 14 and by bolts 40 and 42 through opposite ends of strip 34 and into limb 16. Bolts 38 and 42 may, for example, pass through, respectively, the tip holes 44 which are normally present in limbs 14 and 16 to prevent their longitudinal cracking. Holes 46 may already be present in limbs 14 and 16 for attachment of limbs 14 and 16 to handle 18.

As an example, with bow limbs 14 and 16 each of about 19.5 inch length, strips 32 and 34 may each be about 16–17 inches long, about 0.125 inch thick, and about 2.75 inches wide at their base, tapering to about 2.0 inches in width. They can increase the draw weight, for example, from about 45 pounds to about 65 pounds, rendering bow assembly useful for target archery without strips 32 and 34 installed and useful for hunting with strips 32 and 34 installed. Strips 32 and 34 are inexpensive and rapid and easy to install and remove from bow 12, and can be made in any thickness to increase the draw weight in any desired amount. It is preferred to mount strips 32 and 34 on front surfaces 28 and 30 of limbs 14 and 16, to prevent undue compression and cracking of strips 32 and 34, although strips 32 and 34 could be mounted on the rear surfaces of limbs 14 and 16 or on both the front and rear surfaces thereof.

FIGS. 3–8

Figure 3:
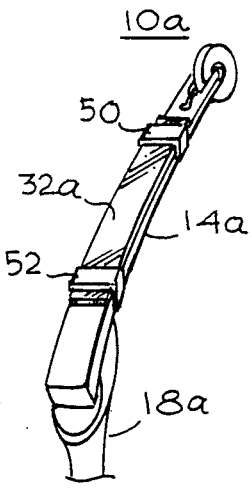
FIG. 3 is a fragmentary schematic perspective view of a second preferred embodiment of the improved archery bow assembly of the present invention.
Figure 4:
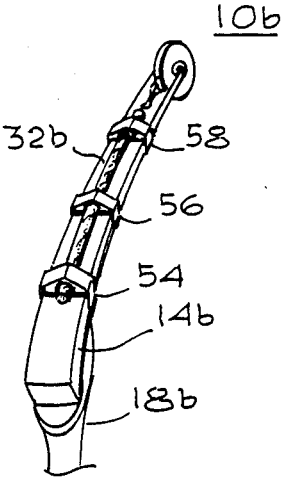
FIG. 4 is a fragmentary schematic perspective view of a third preferred embodiment of the improved archery bow assembly of the present invention.
Figure 8:
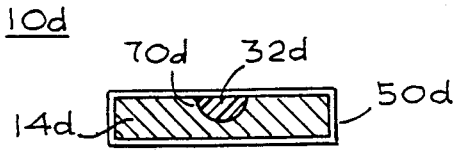
Figure 7:
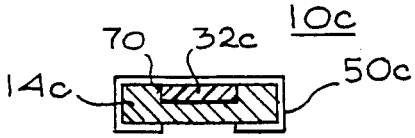
FIG. 7 is a schematic transverse cross-section of the limb, bracket and strip of the assembly of FIG. 6; and, FIG. 8 is a schematic transverse cross-section of a modified form of the limb, bracket and strip utilizable in the assembly of the present invention.
Figure 6:
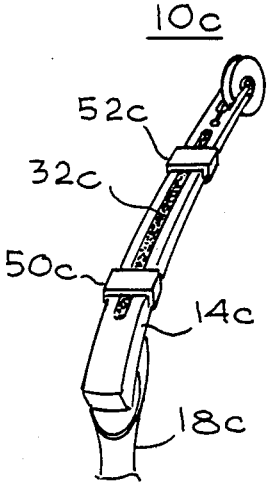
FIG. 6 is a fragmentary schematic perspective view of a fourth preferred embodiment of the improved archery bow assembly of the present invention.
Figure 5:
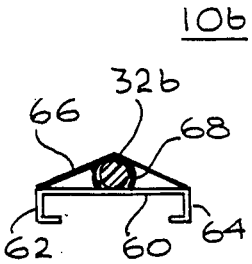
FIG. 5 is an enlarged, schematic front elevation of the rod and bracket components of the assembly of FIG. 4.

Second, third and fourth preferred embodiments of the improved assembly of the invention are schematically depicted in FIG. 3 (second embodiment), FIGS. 4 & 5 (third embodiment) and FIGS. 6 & 7 (fourth embodiment). A further modification is shown in FIG. 8. Components similar to those of FIG. 1 bear the same numerals but are succeeded by the letter "a" for FIG. 3, "b" for FIGS. 4 & 5, "c" for FIGS. 6 & 7 and "d" for FIG. 8.

In FIG. 3, assembly 10*a* is shown and is substantially identical to assembly 10 in all respects, except that strip 32*a* of fiberglass is secure to limb 14*a* by a pair of spaced metal brackets 50 & 52 which transversely span, encircle and tightly grip strip 32*a* and limb 14*a*, releasably securing them together.

In FIGS. 4 & 5, assembly 10*b* is shown which includes a cylindrical rod 32*b* of, for example, wood, fiberglass, plastic or metal, secured by three identical, spaced brackets 54, 56 and 58 to limb 14*b*, in turn secured to handle 18*b* of assembly 10*b*. Bracket 54 is shown in FIG. 5 and may be of metal, plastic, etc. It includes a plate 60 bearing channel-shaped gripping side margins 62 and 64 and an upraised triangular component 66 bearing a hoop 68 adapted to grip and compress rod 32*b*.

FIGS. 6 & 7 show assembly 10*c* which is identical to assembly 10 except that strip 32*c* is inset in a longitudinal groove 70 (FIG. 7) in limb 14*c* and is held therein by a pair of spaced brackets 50*c* and 52*c* similar to those of FIG. 3. Alternatively, strip 32*c* could be releasably glued in place in groove 70.

FIG. 8 shows a variation identical to that of FIGS. 6 and 7, except that assembly 10*d* thereof has a semi-circular (in transverse cross-section) groove 70*d* which runs longitudinally of limb 14*d* in which rod 32*d* is releasably secured by a plurality of spaced brackets 50*d* or by tape.

Assemblies 10*a*, 10*b*, 10*c* and 10*d* have substantially the advantages of assembly 10 and can be made of similar materials. Brackets 50, 52, 54, 56, 58, 50*c*, 52*c* and 50*d* can be secured to the respective limbs and strips either by removing the wheels attached to those limbs and slipping the brackets over the limb and strip from the wheel end of the limb, or, depending on the construction of the brackets, flexing them temporarily just enough to slip them into place and then letting them spring back to their original shape. Other methods of installation thereof will also be obvious.

Various modifications, changes, alterations and additions can be made in the improved archery bow assembly of the present invention, its components and their parameters. All such modifications, changes, alterations and additions as are within the scope of the appended claims form part of the present invention.

What is claimed is:

1. An improved compound archery bow assembly, said assembly comprising, in combination:

a. a compound archery bow having a pair of flexible resilient curved bow limbs having flat non-indented front surfaces, a handle interconnecting said bow limbs, a bowstring trained around pulley wheels connected to the tips of said bow limbs, and an arrow rest; and, b. a pair of elongated, flexible, resilient draw weight-increasing flat strips releasably secured directly to and abutting the front surfaces of said bow limbs along the length thereof by retainers selected from the group consisting of bolts, screws and brackets.

2. An improved compound archery bow assembly, said assembly comprising, in combination:

a. a compound archery bow having a pair of flexible resilient curved bow limbs, a handle interconnecting said bow limbs, a bowstring trained around pulley wheels connected to the tips of said bow limbs, and an arrow rest; and, b. a pair of elongated, flexible, resilient draw weight-increasing flat strips releasably secured directly to and abutting at least one of the front and rear surfaces of said bow limbs along the length thereof by bolts extending through the opposite ends of said limbs and flat strips, said flat strips having elongated bolt-receiving slots at one end thereof to accommodate the associated bolt and permit slight movement between the flat strip and the limb to which it is connected during flexing of said strip and limb.

3. The improved compound archery bow assembly of claim 2 wherein said limbs are releasably connected to said handle by those of said bolts which releasably secure one end of said strips to said limbs, and wherein said pulley wheels are disposed in longitudinally extending slots in the tips of said limbs, through which said limb tips slots certain of said bolts pass to releasably connect one end of said strips to said limbs.

4. The improved compound archery bow assembly of claim 3 wherein said elongated strip slots and elongated limb tips slots are dimensioned relative to said bolts to permit releasable connection of flat strips of different lengths to said bow limbs in order to closely control the draw weight of said bow assembly.

* * * * *